US006189498B1

(12) United States Patent
Yonezawa et al.

(10) Patent No.: US 6,189,498 B1
(45) Date of Patent: Feb. 20, 2001

(54) CAM SHAFT DRIVE FOR ENGINE

(76) Inventors: Minoru Yonezawa; Takeo Kondo; Daisuke Takasu, all of c/o 2500 Shingai, Iwata-shi, Shizuoka-ken (JP)

( * ) Notice: Under 35 U.S.C. 154(b), the term of this patent shall be extended for 0 days.

(21) Appl. No.: 09/441,317

(22) Filed: Nov. 16, 1999

(30) Foreign Application Priority Data

Nov. 18, 1998 (JP) ..... 10-328452

(51) Int. Cl.[7] ..... F01L 1/34
(52) U.S. Cl. ..... 123/90.15; 123/90.17; 123/90.31
(58) Field of Search ..... 123/90.15, 90.16, 123/90.17, 90.18, 90.31

(56) References Cited

U.S. PATENT DOCUMENTS 4,805,566 * 2/1989 Ampferer ..... 123/90.15
5,033,421 * 7/1991 Shimada et al. ..... 123/90.27
5,144,920 * 9/1992 Imperial ..... 123/90.15
5,152,261 * 10/1992 Butterfield et al. ..... 123/90.15
5,323,739 * 6/1994 Mollers ..... 123/90.15
5,606,941 * 3/1997 Trzmiel et al. ..... 123/90.15
5,740,768 * 4/1998 Sakurai et al. ..... 123/90.27

* cited by examiner

*Primary Examiner*—Weilun Lo

(57) ABSTRACT

A number of embodiments of internal combustion engines that embody a variable valve timing mechanism for varying the valve timing during engine operation. The variable valve timing mechanism includes at least one VVT device that is located at a position that is remote from the cam shaft and in each embodiment is mounted in the cylinder block.

16 Claims, 4 Drawing Sheets

CAM SHAFT DRIVE FOR ENGINE

BACKGROUND OF THE INVENTION

This invention relates to an internal combustion engine and more particularly to an improved cam shaft drive for such engines employing a variable valve timing mechanism.

In order to improve the flexibility of internal combustion engines and to provide a more desirable power curve, it has been proposed to employ a variable valve timing mechanism. By varying the phase angle of one or both cam shafts, it is possible to obtain optimum valve events for most running conditions of the engine.

The conventional type of variable valve timing mechanism (VVT) is normally positioned in the connection between a driving element mounted on the cam shaft and the cam shaft itself. These VVT mechanisms employ a hydraulically operated mechanism that shifts the phase angle of the cam shaft from its driving element, normally a sprocket.

Although the use of variable valve timing mechanisms has considerable advantages, the placement of the variable valve timing mechanism at the driving connection between the cam shaft and its driving element has some disadvantages. First, the variable valve timing mechanism has a fairly substantial size and thus, the overall length of the engine is generally increased through the use of VVT mechanisms. Also, when the mechanism is disposed in cantilevered fashion at the outward end of the cam shaft, there can be relatively high bending loads exerted on the cam shaft and heavy wear in the adjacent cam shaft bearing may result.

Also, the variable valve timing mechanisms are normally powered by the lubricant from the lubricating system of the engine. At times, this can present some problems in the delivery and return of the lubricating oil to and from the VVT mechanism.

It is, therefore, a principal object of this invention to provide an improved cam shaft driving arrangement for an engine.

It is a further object of this invention to provide an engine cam shaft driving arrangement wherein the cam shaft is driven by a variable valve timing mechanism that is not mounted at the end of the controlled cam shaft.

It is a further object of this invention to provide a variable valve timing mechanism that is interposed in the cam shaft driven in such a way as to minimize the size added to the engine.

SUMMARY OF THE INVENTION

This invention is adapted to be embodied in an internal combustion engine having an engine body that defines a combustion chamber and a cam shaft operated valving arrangement for controlling the admission of a charge to the combustion chamber and the discharge of a burnt charge from the combustion chamber. A piston reciprocates in the combustion chamber and drives an engine crankshaft. A timing driving drives the cam shaft from the engine crankshaft in timed relationship. This timing drive includes a variable valve timing mechanism for varying the phase relationship between the crankshaft and a cam shaft. The variable valve timing mechanism is located at a point that is displaced from the ends of the cam shaft.

In a preferred embodiment, the variable valve timing mechanism includes a component for varying the phase angle that is mounted on an intermediate shaft in the timing drive.

DETAILED DESCRIPTION OF THE PREFERRED EMBODIMENTS

Figure 1:
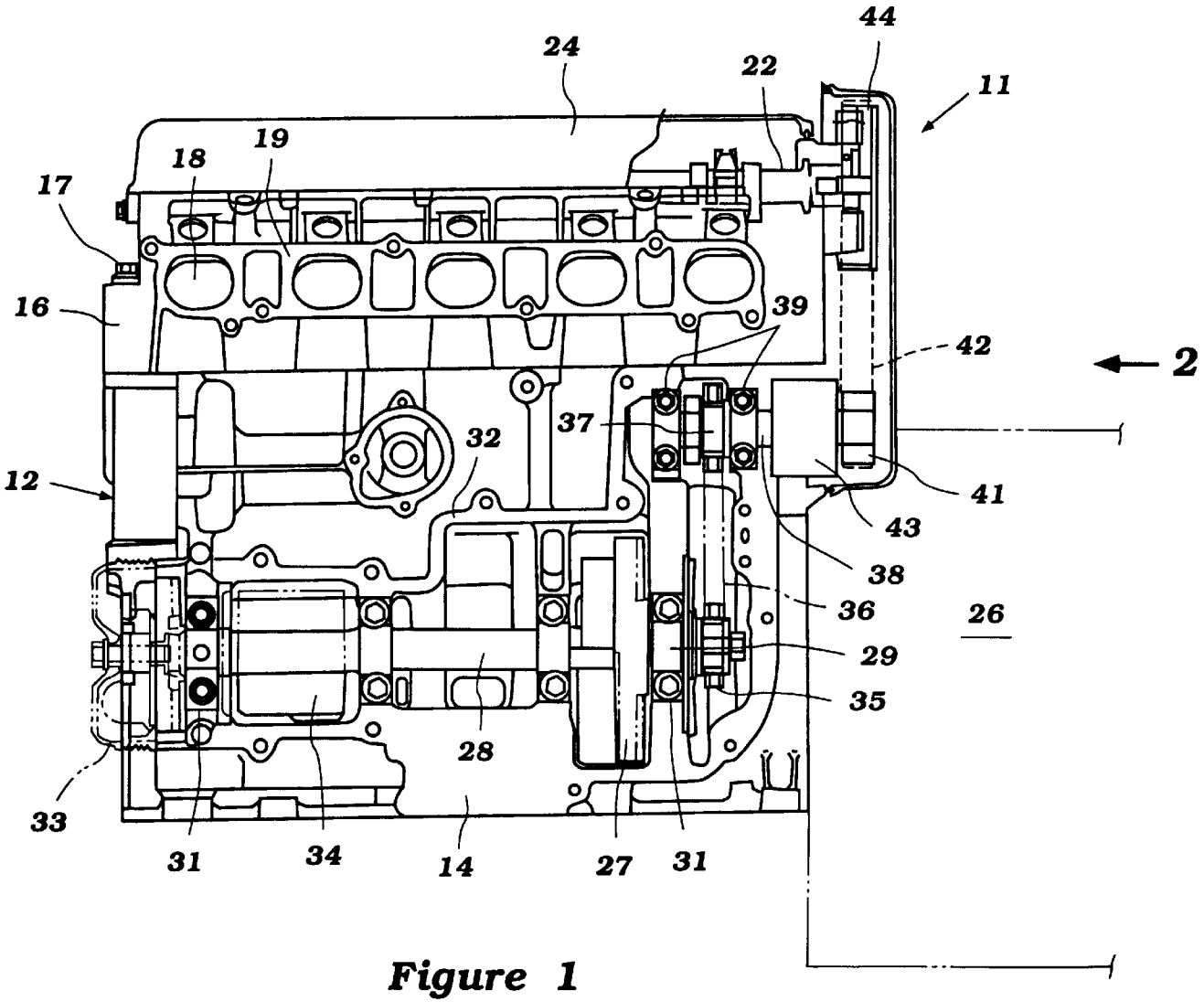
FIG. 1 is a side elevational view of an internal combustion engine constructed in accordance with a first embodiment of the invention, with certain components of the engine removed and other components broken away so as to more clearly show the construction.
Figure 2:
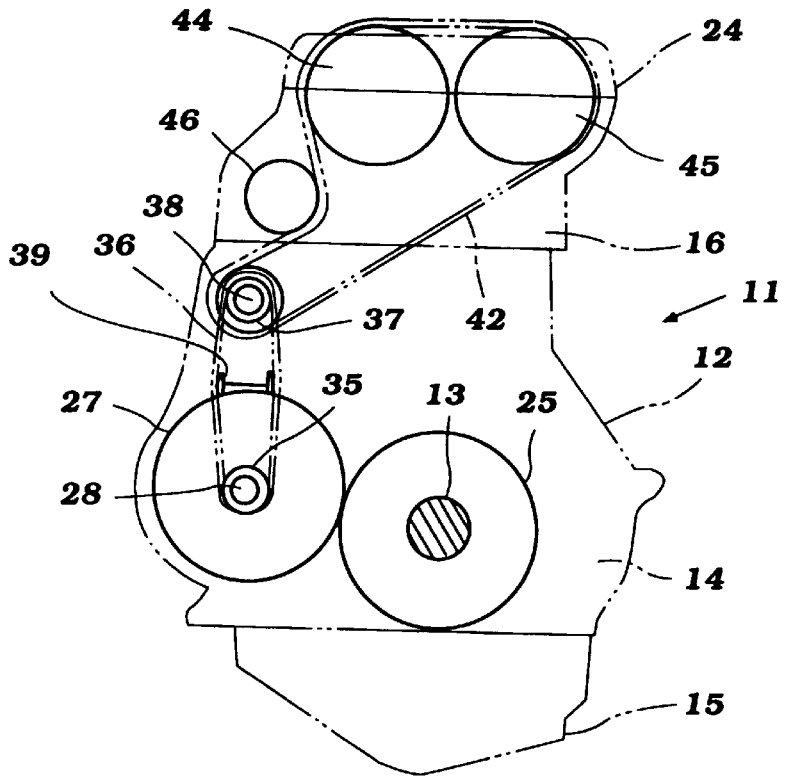
FIG. 2 is a view looking generally in the direction of the arrow to in FIG. 1 and shows the cam shaft drive in solid lines and the remainder of the engine in phantom.
Figure 3:
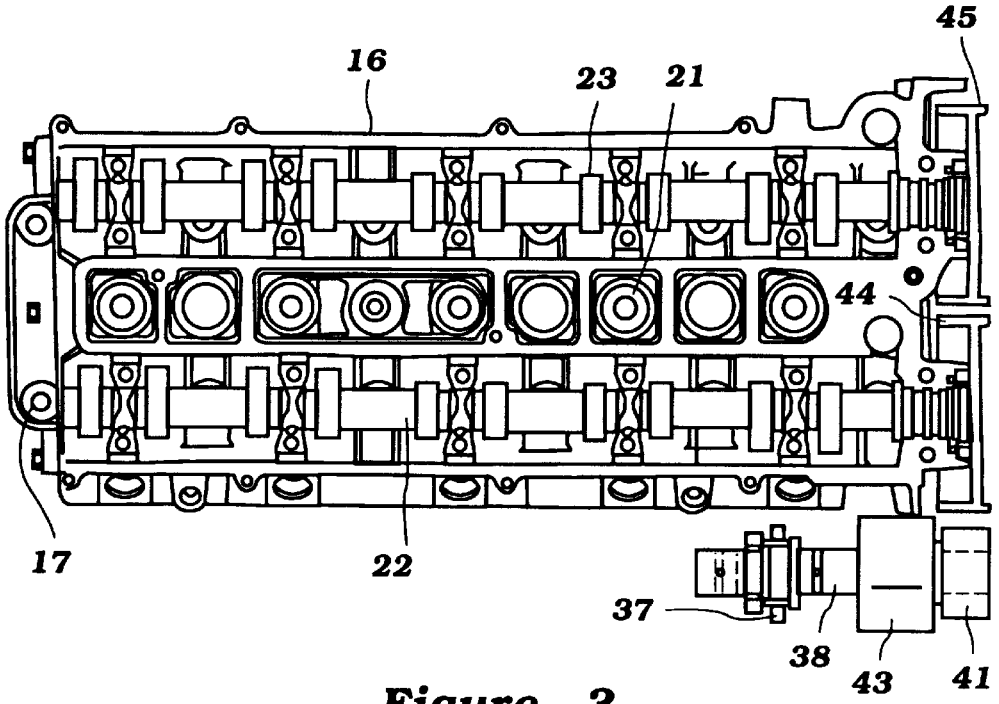
FIG. 3 is a top plan view of the engine with the cam cover removed and with a portion of the valve drive displaced so as to more clearly show this construction.

Embodiment of FIGS. 1–3

Referring first to this embodiment, an engine constructed in accordance with it is identified generally by the reference numeral 11. As should be apparent from the foregoing description, the invention deals primarily with the cam shaft drive arrangement for the engine 11. Therefore, a number of the components of the engine which form no part of the invention such as the pistons, valves, etc. are not illustrated and will not be described in detail. Those skilled in the art will readily understand how the invention can be practiced with a variety of types of engines including engines having other cylinder numbers and other cylinder configurations from that described herein.

The engine 11 is comprised of an engine body that includes a cylinder block 12 in which a plurality of cylinder bores are formed. In this particular embodiment, there are five such cylinder bores. Pistons reciprocate in the cylinder bores and drive a crankshaft 13 that is rotatably journaled at the lower end of the cylinder block 12 within a crankcase chamber. This crankcase chamber is formed by a skirt 14 of the cylinder block and by an oil pan or crankcase forming member 15 that is attached thereto.

The pistons in the cylinder bores form combustion chambers along with the cylinder bores and suitably shapes combustion chamber recesses formed in a cylinder head assembly 16 that is affixed to the cylinder block 12 by means that include threaded fasteners 17.

An intake manifold, which is not shown, cooperates to supply at least an air charge to these combustion chambers through a plurality of intake ports 18 formed in a side surface 19 of the cylinder head 16. This intake manifold collects air from within the engine compartment, assuming the engine 11 is employed to power a motor vehicle as is a typical but not necessarily the sole environment in which the invention can be utilized. Throttle valves and other components are associated with this induction system.

An exhaust system (not shown) is affixed to the opposite side of the cylinder head 16 for discharging the burnt combustion products from the combustion chambers.

Spark plugs 21 (FIG. 3) are mounted in the cylinder head assembly 16 and fired in a known manner for igniting a fuel air charge which has been admitted to the combustion chambers. Fuel is mixed with the inducted air by a suitable charge former which may include manifold or direct cylinder fuel injection.

Intake and exhaust valves open and close the intake passages 18 and the exhaust passages (not shown) for controlling the flow into and out of the combustion chambers. Since these valves may be of any known type, they are not illustrated.

However, the valves are operated by means of an actuating system that includes an intake cam shaft 22 and an exhaust cam shaft 23. The intake and exhaust cam shafts 22 and 23 are journaled in the cylinder head assembly 16 in a known manner. This may include bearing surfaces formed directly in the cylinder head member 16 and bearing caps that are affixed thereto. The cam shafts 22 and 23 and the valve actuating mechanism are closed by a cam cover 24 that is affixed to the cylinder head 16 in any suitable manner.

As is well known, the cam shaft 22 and 23 are driven in a timed relationship with the crankshaft 23 at one half of crankshaft speed. This is to accommodate the four cycle operation of the engine 11. This cam shaft timing drive includes a timing gear 25 that is fixed to the crankshaft 13 at a suitable location and preferably one that is located between the throws of the crankshaft associated with the first and second cylinders. These cylinders are counted beginning at the end of the engine shown in FIG. 2 and at the right hand side of FIG. 1.

It should be noted that this orientation of the engine 11 is chosen so as to provide a transverse mounting of the engine 11 the engine compartment of an associated motor vehicle. This permits the driving of the vehicle through a transmission 26 that is driven off of the crankshaft 13 in this suitable manner.

Although the application of the engine 11 to powering a motor vehicle is a normal embodiment in which the invention is utilized, it should be readily apparent to those skilled in the art that the invention can be utilized with any of a wide variety of types of engine applications, particularly where a compact engine construction is required as well as an output that is optimum under substantially all engine running conditions.

Continuing to refer to the drive for the cam shafts 22 and 23, the crankshaft timing gear 25 is enmeshed with a balancer shaft timing gear 27 that is affixed to a balancer shaft 28. The balancer shaft 28 is journaled in one side of the cylinder block 12 by spaced bearing surfaces that are formed integrally therein and to which bearing caps 29 are affixed by threaded fasteners 31. It should be noted that this balancer shaft 28 is mounted within a cavity in one side of the cylinder block 12 that is surrounded by a flange 32. A suitable cover plate, which is removed in FIG. 1, is mounted over an and encloses this mechanism.

The balancer shaft 28 does not extend beyond the end of the engine 11 where the cam shaft timing drive is located. This is to afford a compact construction.

If desired, the opposite end of the balancer shaft 28 may have affixed to it a drive pulley 33 for driving a plurality of accessories. A balancer mass 34 is also affixed to the balancer shaft 28 so as to assist in engine balancing.

The balancer shaft 28 has a drive sprocket 35 affixed to its end opposite the end where the accessory drive pulley 33 is located. This drive sprocket 35 is contained within the engine body and thus may drive a chain 36. Although a chain drive is described, it should be apparent to those skilled in the art that other types of flexible transmitters or timing drives can be employed in this relationship.

The timing chain 36 drives a timing sprocket 37 that is affixed to a cam driving shaft 38 which is journaled at the same side of the cylinder block 12 and at the upper end of the recessed bounded by the flange 32. This cam driving shaft 38 is also mounted by bearings formed in the cylinder block 12 and bearing caps that are affixed thereto by threaded fasteners 39. As may be seen in FIG. 2, a suitable tensioner mechanism 39 may be provided to act on the timing chain 36 to maintain the desired tension in this flexible transmitter drive.

Extending outwardly beyond the right hand end of the engine 11, there is provided a further driving sprocket 41 which is also formed with teeth for ensuring a positive drive. At this location, however, a drive belt 42 is driven by the sprocket 41. Although the invention is described in conjunction with a belt drive at this location, it should be readily apparent to those skilled in the art that other forms of timing drives may be employed including those using a chain.

The driving sprocket 41 is not driven directly by the cam driving shaft 38. Rather, however, a variable valve timing mechanism, indicated generally by the reference numeral 43 and which may be of any known type is interposed in this drive. This variable valve timing mechanism 43 functions so as to shift the phase angle between the crankshaft 13 and the cam shafts 22 and 23.

The flexible transmitter 42 is enmeshed with a pair of driven sprockets 44 and 45 which, in this embodiment, are fixed to the ends of the intake and exhaust cam shafts 22 and 23, respectively. An idler or tensioner pulley 46 engages the back side of the transmitter 42 so as to maintain the appropriate tension in it.

Thus, it should be seen that in this embodiment, the variable valve timing mechanism 43 is disposed at a spaced location from the ends of the cam shafts 22 and 23 and inboard of the outer periphery of the engine so as to avoid any undue lengthening of the engine 11. Also, the inboard location facilitates the delivery of lubricant from the engine lubricating system to the VVT mechanism 43 for its actuation. Any suitable control valve arrangement and location can be employed for operating this mechanism in accordance with any desired strategy.

Figure 4:
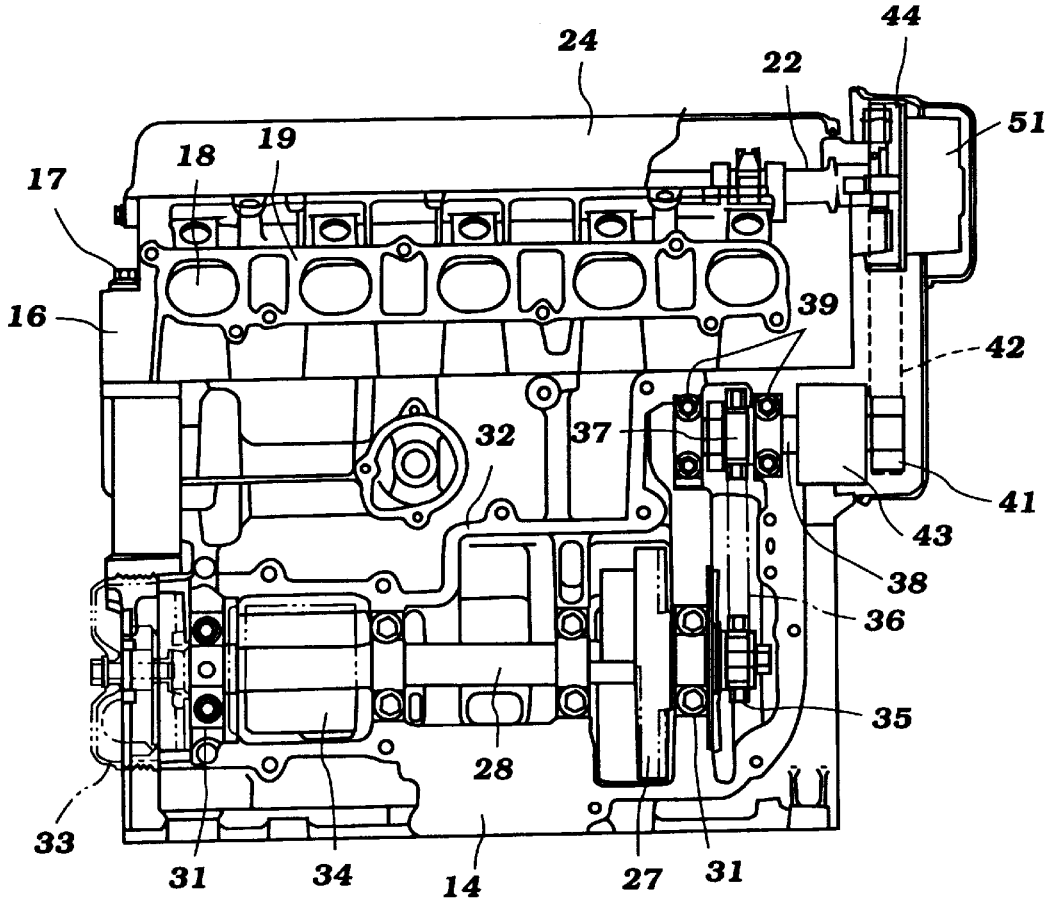
FIG. 4 is a side elevational view, in part similar to FIG. 1 and shows a second embodiment of the invention.
Figure 5:
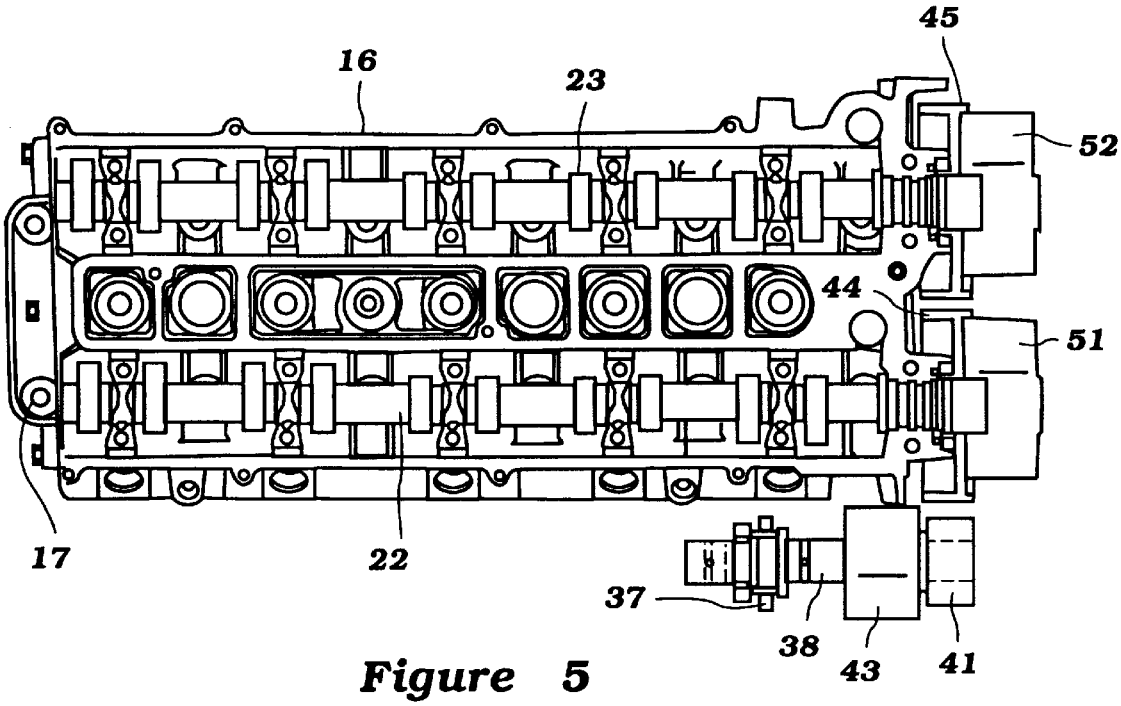
FIG. 5 is a top plan view of this embodiment and is, in part, similar to FIG. 3.

Embodiment of FIGS. 4 and 5

In the embodiment as thus far described, there has been provided one variable valve timing mechanism, the mechanism 43 that is interposed in the connection between the cam driving shaft 38 and the drive sprocket 41 associated therewith. Because of this, the timing phase change between the crankshaft 13 and the cam shafts 22 and 23 will be the same. Although this is acceptable for many engine applications, it may be desirable to be able to provide independent adjustment of the timing of the two cam shafts 22 and 23.

FIGS. 4 and 5 show such an embodiment. In this embodiment, however, the variable valve timing mechanism 43 and the drive as thus far described is again repeated. Because of that, components which are the same or substantially the same have been identified by the same reference numerals and will be described again only insofar as is necessary to permit those skilled in the art to understand and practice the invention of this embodiment.

In this embodiment, each of the cam shafts 22 and 23 is driven from its respective driven sprocket 44 and 45 through a respective variable valve timing mechanism, indicated by the reference numerals 51 and 52, respectively. However, since the major portion of the phase shift may be made in and by the variable valve timing mechanism 43, these VVT mechanisms 51 and 52 may be smaller than those normally employed wherein all of the phase shift must be accomplished in one mechanism.

Thus, although this embodiment does not have all of these advantages of the embodiment of FIGS. 1–3, it does permit a compact engine construction than the prior art type arrangements where all of the phase reduction is accomplished by a single VVT mechanism at the end of the respective cam shaft.

Figure 6:
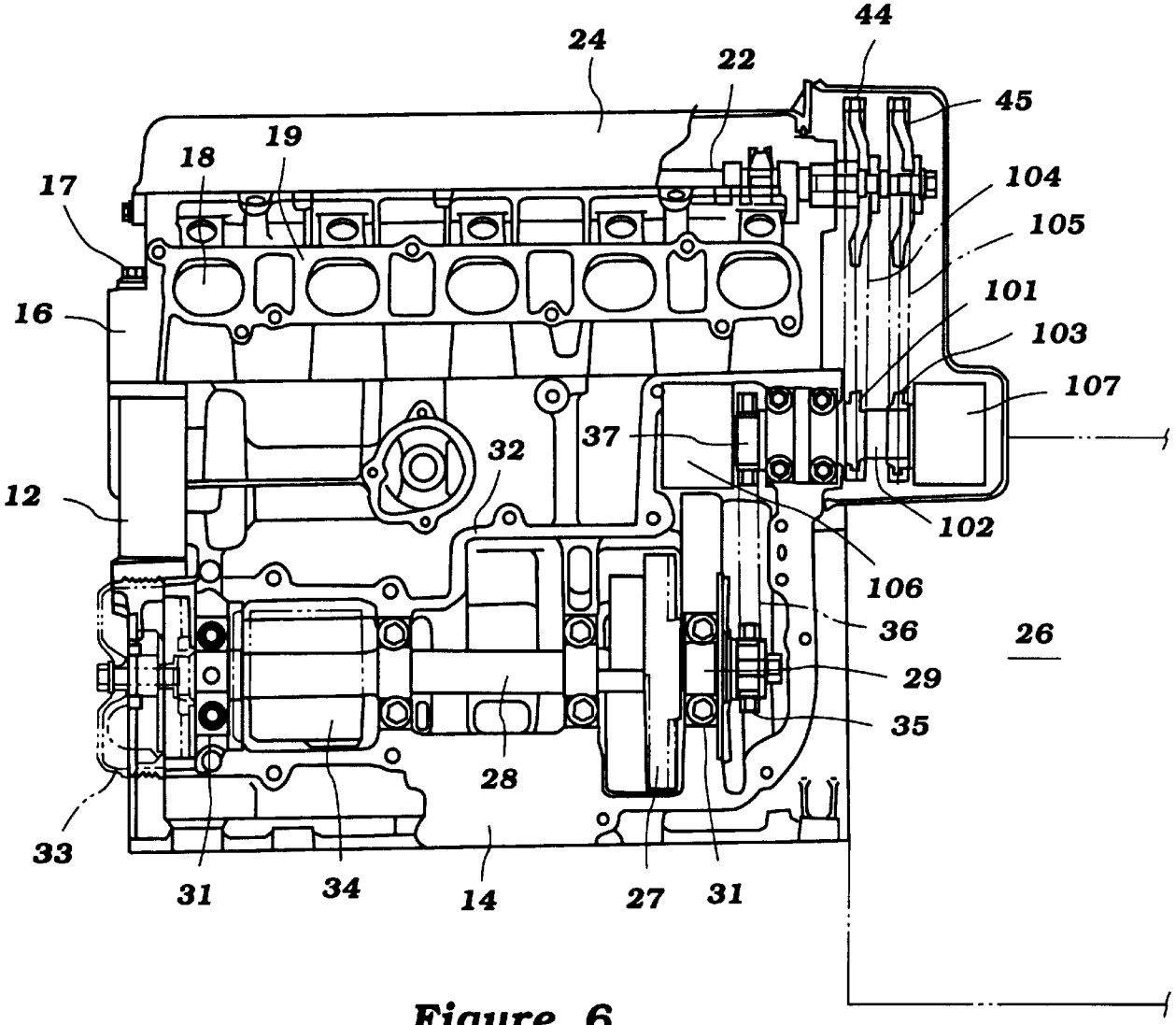
FIG. 6 is a side elevational view, in part similar to FIGS. 1 and 3 and shows a third embodiment of the invention.

Embodiment of FIG. 6

FIG. 6 shows an embodiment wherein the timing phase of the cam shafts 22 and 23 may be made completely independently of each other. In this embodiment, however, this is accomplished by utilizing VVT mechanisms that are spaced from the ends of the two cam shafts and not directly located at the cam shafts as with the embodiment of FIGS. 4 and 5.

This embodiment also uses the cam driving shaft 38 that is driven from the balancer shaft in the manner already described. However, in this embodiment, the driving sprocket 37 of the intermediate shaft is coupled to a pair of quill shafts one of which carries an intake cam shaft driving sprocket 101 and the other of which, indicated by the reference numeral 102 which drives a cam driving sprocket 103 for the exhaust cam shaft. Thus, the intake and exhaust cam shafts are still driven by the sprockets 44 and 45, respectively but through separate chains 104 and 105.

Suitable variable valve timing mechanisms 106 and 107 are interposed between the driving sprocket 37 and the cam driving sprockets 101 and 103, respectively. Thus, the phase angle of the sprockets 101 and 103 can each be controlled independently by their respective VVT mechanisms 106 and 107, respectively. However, the upper portion of these engine is not significantly elongated because of the remote location of the VVT mechanisms.

Thus, from the foregoing description it should be readily apparent that the described embodiments of the invention provide a very effective VVT mechanism for an internal combustion engine and one which permits a compact engine construction and facilitates the control and supply of actuating fluid to the VVT mechanism. Of course, the foregoing description is that of preferred embodiments of the invention. It will be readily apparent to those skilled in the art that various changes and modifications may be made without departing from the spirit and scope of the invention, as defined by the appended claims.

What is claimed is:

1. An internal combustion engine having an engine body defining at least one combustion chamber in which a piston reciprocates for driving a crankshaft for rotation about a crankshaft axis that extends longitudinally of said engine body, a valve mechanism for controlling the admission of a charge to said combustion chamber and the discharge of a burnt charge from said combustion chamber, said valve mechanism including at least one valve operating shaft, said valve operating shaft being journaled for rotation about a rotational axis that extends parallel to said crankshaft axis, a timing drive for driving said valve operating shaft in timed rotation from said crankshaft comprising at least one intermediate shaft directly driven by said crankshaft through a first drive and driving said valve operating shaft through a second drive, said timing drive including a variable valve timing mechanism disposed in the driving connection between one of said first and second drives and said intermediate shaft for varying the phase angle between said crankshaft and said valve operating shaft, said variable valve timing mechanism being disposed at a location that is spaced from the ends of said valve operating shaft.

2. An internal combustion engine having as set forth in claim 1, wherein the variable valve timing mechanism is spaced transversely from the rotational axis of the valve operating shaft.

3. An internal combustion engine having as set forth in claim 1, wherein the engine body includes a cylinder block and a cylinder head detachably connected thereto, the valve operating shaft being journaled in said cylinder head and the variable valve timing mechanism being located within said cylinder block.

4. An internal combustion engine having as set forth in claim 3, wherein the intermediate shaft is journaled at an upper portion of the cylinder block adjacent the cylinder head and at one side of the said cylinder block.

5. An internal combustion engine having as set forth in claim 1, wherein the first drive includes a balancer shaft driven by the crankshaft and driving the intermediate shaft.

6. An internal combustion engine having as set forth in claim 1, further including a second variable valve timing mechanism interposed between the intermediate shaft and the valve operating shaft for varying the phase angle between said intermediate shaft and said valve operating shaft.

7. An internal combustion engine having as set forth in claim 1, wherein the valve operating shaft comprises a pair of cam shafts each operating at least one respective intake and exhaust valve and the phase angle between the crankshaft and each of the cam shafts is adjusted by a variable valve timing mechanism.

8. An internal combustion engine having as set forth in claim 7, wherein a single variable valve timing mechanism varies the phase angle between the crankshaft and the cam shafts.

9. An internal combustion engine having as set forth in claim 8, wherein the variable valve timing mechanism is spaced transversely from the rotational axes of both of the cam shafts.

10. An internal combustion engine having as set forth in claim 8, wherein the engine body includes a cylinder block and a cylinder head detachably connected thereto, the cam shafts being journaled in said cylinder head and the variable valve timing mechanism being located within said cylinder block.

11. An internal combustion engine having as set forth in claim 8, wherein the second drive drives both of the cam shafts.

12. An internal combustion engine having as set forth in claim 11, wherein the engine body includes a cylinder block and a cylinder head detachably connected thereto, the cam shafts being journaled in said cylinder head and the variable valve timing mechanism being located within said cylinder block.

13. An internal combustion engine having as set forth in claim 12, wherein the intermediate shaft is journaled at an upper portion of the cylinder block adjacent the cylinder head and at one side of the cylinder block.

14. An internal combustion engine having as set forth in claim 11, wherein the first drive includes a balancer shaft driven by the crankshaft and driving the intermediate shaft.

15. An internal combustion engine having as set forth in claim 12, further including second and third variable valve timing mechanisms each interposed in the driving connection between the second drive and the respective cam shaft.

16. An internal combustion engine having as set forth in claim 12, wherein there are a pair of variable valve timing mechanisms, each interposed between a respective second drive and one of the cam shafts.

* * * * *